US009855470B1

(12) United States Patent
Cassidy

(10) Patent No.: US 9,855,470 B1
(45) Date of Patent: Jan. 2, 2018

(54) BALL PIT APPARATUS

(71) Applicant: CASDON LIMITED, Lancashire (GB)

(72) Inventor: Paul Cassidy, Lytham St. Annes (GB)

(73) Assignee: Casdon Limited, Blackpool (GB)

( * ) Notice: Subject to any disclaimer, the term of this patent is extended or adjusted under 35 U.S.C. 154(b) by 0 days.

(21) Appl. No.: 15/604,340

(22) Filed: May 24, 2017

(30) Foreign Application Priority Data

Aug. 30, 2016 (GB) ..... 1614654.0

(51) Int. Cl.
*A63B 47/00* (2006.01)
*A63H 33/00* (2006.01)
(Continued)

(52) U.S. Cl.
CPC ..... *A63B 47/025* (2013.01); *A63B 5/00* (2013.01); *A63G 31/12* (2013.01); *A63H 33/008* (2013.01); *A63B 2047/028* (2013.01)

(58) Field of Classification Search
CPC ..... A63B 47/025; A63B 2047/028
(Continued)

(56) References Cited

U.S. PATENT DOCUMENTS 5,758,992 A * 6/1998 Sawallisch ..... A63B 47/025 406/151
6,264,202 B1 * 7/2001 Briggs ..... A63B 9/00 273/394
(Continued)

FOREIGN PATENT DOCUMENTS

DE 202016101898 U1 5/2016
EP 1114662 A2 7/2001
GB 2323306 A 9/1998

OTHER PUBLICATIONS

Step2 Catch & Play Ball Pit, http://www.step2.com/p/Catch-Play-Ball-Pit, captured Jan. 9, 2014.*
(Continued)

*Primary Examiner* — Melba Bumgarner
*Assistant Examiner* — Laura L Davison
(74) *Attorney, Agent, or Firm* — NK Patent Law, PLLC

(57) ABSTRACT

A ball pit apparatus for use with a plurality of balls. The ball pit apparatus includes: a base portion configured to provide a ball pit for holding a plurality of balls, wherein the base portion includes one or more inflatable side walls configured to, when inflated, extend around a periphery of the base portion; a roof portion configured to provide a ball chamber for holding a plurality of balls above the base portion; one or more inflatable supports configured to, when inflated, hold the roof portion above the base portion; a suction inlet configured to be in fluid communication with the ball chamber so that, when suction is provided at the suction inlet, suction is also provided to the ball chamber; a ball inlet configured to be in fluid communication with the ball chamber so that, when suction is provided to the ball chamber, a ball received at the ball inlet is drawn into the ball chamber. The roof portion includes an opening configured to face the base portion when the one or more inflatable supports are inflated. The roof portion includes at least one blocking element configured to block the opening so as to prevent balls from falling through the opening when suction is provided to the ball chamber and to not block the opening so as to allow balls to fall through the opening when suction is not provided to the ball chamber.

23 Claims, 4 Drawing Sheets

(51) Int. Cl.
*A63B 47/02* (2006.01)
*A63B 5/00* (2006.01)
*A63G 31/12* (2006.01)

(58) Field of Classification Search
USPC ..... 273/458, 459; 472/134; 446/220–226
See application file for complete search history.

(56) References Cited

U.S. PATENT DOCUMENTS 7,311,610 B2 * 12/2007 Ochi ..... A63B 5/11 273/129 AP
7,325,576 B2 * 2/2008 Peterson ..... F16L 11/118 138/106
7,335,109 B2 * 2/2008 Chen ..... A63G 31/12 446/220
2005/0194058 A1 * 9/2005 Hanchett ..... A63G 31/12 141/7
2006/0230655 A1 * 10/2006 Machala ..... G09F 19/08 40/410

OTHER PUBLICATIONS

Moose Mountain, Bubble Gum Playland, http://www.amazon.com/Bubble-Inflatable-Play-Land-Balls/dp/B00065VYJ0, customer reviews dated 2006-2008.*
Ukipo, Combined Search and Examination Report for UK Patent Application No. GB1614654.0, dated Jan 31, 2017.
Roy, "Suck the balls!" Art installation at Goethe-Institut Krakau. See especially video and images. Disclosure dated Mar 26, 2014 (http://laughingsquid.com/suck-the-balls-an-interactive-vacuum-powered-ballmachine/).
THUMPIN204, Pneumatic ball launcher and cascade hatch (https://www.youtube.com/watch?v=BSh7Vq23Ixo).
Amazon.com, Toys & Games "Disney Mickey Having a Ball with 20" (accessed on Aug. 9, 2016).

* cited by examiner

BALL PIT APPARATUS

CROSS REFERENCE TO RELATED APPLICATIONS

This application claims priority to United Kingdom Patent Application No. 1614654.0 filed on Aug. 30, 2016, the content of which is incorporated by reference herein.

FIELD OF THE INVENTION

This invention relates to a ball pit apparatus for use with a plurality of balls, e.g. hollow plastic balls.

BACKGROUND

Ball pit apparatuses, more commonly known as "ball pits", are well known. They typically include a pit for holding a plurality of balls, usually hollow plastic balls of varying colours. Users (typically children) enjoy sitting in and playing with the balls.

More recently, ball pits have been created for home use. However, such ball pits are typically lack functionality beyond provision of a simple pit.

The present invention has been devised in light of the above considerations.

SUMMARY OF THE INVENTION

A first aspect of the invention may provide:

A ball pit apparatus for use with a plurality of balls, the ball pit apparatus including:

a base portion configured to provide a ball pit for holding a plurality of balls, wherein the base portion includes one or more inflatable side walls configured to, when inflated, extend around a periphery of the base portion;

a roof portion configured to provide a ball chamber for holding a plurality of balls above the base portion;

one or more inflatable supports configured to, when inflated, hold the roof portion above the base portion;

a suction inlet configured to be in fluid communication with the ball chamber so that, when suction is provided at the suction inlet, suction is also provided to the ball chamber;

a ball inlet configured to be in fluid communication with the ball chamber so that, when suction is provided to the ball chamber, a ball received at the ball inlet is drawn into the ball chamber;

wherein the roof portion includes an opening configured to face the base portion when the one or more inflatable supports are inflated;

wherein the roof portion includes at least one blocking element configured to block the opening so as to prevent balls from falling through the opening when suction is provided to the ball chamber and to not block the opening so as to allow balls to fall through the opening when suction is not provided to the ball chamber.

In use, the ball pit may be filled with balls, and suction may be provided at the suction inlet (e.g. by a suction device such as a vacuum cleaner), which in turn provides suction to the ball chamber, with the at least one blocking element blocking the opening so as to prevent balls from falling through the opening. Whilst suction is being provided at the suction inlet, a user (typically a child) can cause balls to be received at the ball inlet to draw balls up into and fill the ball chamber. When suction ceases to be provided to the ball chamber (e.g. by turning off or disconnecting the suction device), the opening is no longer blocked by the blocking element and the balls fall back into the ball pit (which may have one or more users sat therein).

By having a base portion with inflatable side walls and one or more inflatable supports, a ball pit apparatus having the above described functionality can be easy erected without special tools, e.g. like a paddling pool, yet stored in a compact manner.

The roof portion may include one or more inflatable side walls configured to, when inflated, extend around a periphery of the roof portion. This further simplifies the erecting of the ball pit apparatus, and may allow the apparatus to be stored in a yet further compact manner.

The base portion may include a floor, which may be inflatable or non-inflatable.

The suction inlet may be configured to receive a nozzle of a suction device, such as a vacuum cleaner, e.g. to facilitate use of the apparatus in a home environment. However, the apparatus could be used with other suction devices.

The apparatus may include a suction tube configured to provide the fluid communication between the suction inlet and the ball chamber.

In some embodiments, at least a portion of the suction tube may be enclosed within and extend along at least a portion of an inflatable support. In this case, the suction inlet may be located on the inflatable support (preferably nearer to the base portion than the roof portion, preferably on a side of the inflatable support that faces away from the ball pit) or on the base portion (preferably on an inflatable side wall of the base portion, preferably facing away from the ball pit).

An enclosed suction tube may help to reduce the bulk of the apparatus and the complexity of erecting the apparatus.

If the suction tube is enclosed within and extends along at least a portion of an inflatable support, the suction tube is preferably configured to stay open under suction when the inflatable support is inflated (note that pressure in the inflated support would push inwards on the suction tube).

This may be achieved, for example, by the inflatable support that encloses at least a portion of the suction tube having a plurality of suction tube support elements circumferentially distributed around the suction tube, each suction tube support element being connected between the suction tube and a wall of the inflatable support, wherein the plurality of suction tube support elements are configured to act (e.g. through being under tension) to keep the suction tube open when the inflatable support is inflated. To this end, there may be four or more, six or more, or eight or more (e.g. twelve) suction tube support elements circumferentially distributed around the suction tube. The inflatable support, the suction tube and the corresponding suction tube support elements may be made of a flexible sheet material, in order to allow the inflatable support, suction tube and corresponding suction tube support elements to be stored flat when the inflatable support is deflated. For example, the suction tube may be made of a first flexible sheet, with a second flexible sheet being folded (and where necessary glued, welded or otherwise sealed) to form the inflatable support and the corresponding ball tube support elements.

In other embodiments, the suction tube may take the form of a rigid tube, or a flexible hose incorporating rigid elements configured to hold open the flexible hose. Such a flexible hose may take the form of a hose of the type found on a typical household vacuum cleaner. However, it is noted that use of rigid tube or flexible hose incorporating rigid elements may prevent the inflatable support and suction tube from being stored flat when the inflatable support is deflated.

Furthermore, a user seeking to flatten the inflatable support post-deflation may damage the rigid tube or flexible hose incorporating rigid elements.

In other embodiments, the suction tube may be external to the one or more inflatable supports. In this case, the suction tube may include a flexible portion, e.g. to allow a user more easily connect the suction tube to a suction device.

The suction tube preferably includes an end which is distal to the suction inlet and open to the ball chamber, wherein a rigid porous body is configured to prevent the distal end of the suction tube from becoming blocked by any balls in the ball chamber (noting that when suction is provided at the suction inlet, this suction would draw balls towards this distal end of the suction tube).

In yet other embodiments, the suction tube may be omitted, e.g. with the suction inlet being provided on the roof portion.

The apparatus may include a ball tube configured to provide fluid communication between the ball inlet and the ball chamber.

In some embodiments, the ball tube may be enclosed within and extend along at least a portion of an inflatable support (preferably within a different inflatable support to the suction tube, if present). In this case, the ball inlet may be located on the inflatable support (preferably nearer to the base portion than the roof portion, preferably on a side of the inflatable support that faces towards the ball pit to allow access by a user in the ball pit) or on the base portion (preferably on an inflatable side wall of the base portion, preferably facing towards the ball pit to allow access by a user in the ball pit).

An enclosed ball tube may be safer than an external ball tube since it may be more difficult for a user to accidentally insert parts of their anatomy (e.g. an eye) into the ball tube, and may further help reduce the bulk of the apparatus and the complexity of erecting the apparatus.

If the ball tube is enclosed within and extends along at least a portion of an inflatable support, the ball tube is preferably configured to stay open to allow balls to pass therethrough when the inflatable support is inflated (note that pressure in the inflated support would push inwards on the ball tube).

This may be achieved, for example, by the inflatable support that encloses at least a portion of the ball tube having a plurality of ball tube support elements circumferentially distributed around the ball tube, each ball tube support element being connected between the ball tube and a wall of the inflatable support, wherein the plurality of ball tube support elements are configured to act (e.g. through being under tension) to keep the ball tube open when the inflatable support is inflated. To this end, there may be four or more, six or more, or eight or more (e.g. twelve) ball tube support elements circumferentially distributed around the ball tube. The inflatable support, the ball tube and the corresponding ball tube support elements may each be made of a flexible sheet material, in order to allow the inflatable support, ball tube and corresponding ball tube support elements to be stored flat when the inflatable support is deflated. For example, the ball tube may be made of a first flexible sheet, with a second flexible sheet being folded (and where necessary glued, welded or otherwise sealed) to form the inflatable support and the corresponding ball tube support elements.

In other embodiments, the ball tube may take the form of a rigid tube, or a flexible hose incorporating rigid elements configured to hold open the flexible hose. Such a flexible hose may take the form of a hose of the type found on a typical household vacuum cleaner. However, it is noted that use of rigid tube or flexible hose incorporating rigid elements may prevent the inflatable support and ball tube from being stored flat when the inflatable support is deflated. Furthermore, a user seeking to flatten the inflatable support post-deflation may damage the rigid tube or flexible hose incorporating rigid elements.

In other embodiments, the ball tube may be external to the one or more inflatable supports. In this case, the ball tube may include a flexible portion, e.g. to allow a user to suck up balls in the fashion of a vacuum cleaner.

In yet other embodiments, the ball tube may be omitted, e.g. with the ball inlet being provided on the roof portion.

If the ball tube and the suction tube are present, the ball tube may have a larger diameter than the suction tube. This may help to reduce air speed in the ball tube compared with the suction tube, and may improve safety.

The at least one blocking element may include at least one trap door, preferably two trap doors. The/each trap door is preferably rigid. The/each trap door may be attached to the roof portion via a respective hinge, which may allow the trap door(s) to hang in an open position so as to not block the opening when suction is not provided to the ball chamber, yet be held in a closed position to block the opening when suction is provided to the ball chamber. With this arrangement, the trap door can fall open under the action of gravity when suction ceases to be provided to the ball chamber. For avoidance of any doubt, whilst the suction provided to the ball chamber should be adequate to hold the trap door(s) in a closed position, the trap door(s) may in some embodiments need be moved into the closed position by hand. In other embodiments, the trap door(s) could be moved into the closed position by suction provided to the ball chamber and/or by another closure mechanism that does not require manual assistance.

Alternatively, the at least one blocking element may include at least one flexible flap. Other configurations could be envisaged.

The one or more inflatable side walls of the base portion, the one or more inflatable supports and optionally the one or more side walls of the roof portion (if present), and optionally the inflatable floor (if present), may collectively be referred to as inflatable elements of the apparatus.

The inflatable elements may, as a group, have one or more openings/valves for allowing the inflatable elements to be inflated/deflated, and optionally plugged.

Two or more (preferably all) of the inflatable elements of the apparatus may be joined together to form a single inflatable chamber. This would simplify inflation of these inflatable elements via a single opening/valve in one of the inflatable elements.

Alternatively, each inflatable element may have a respective inflatable chamber, which allows each inflatable elements to be individually inflated via a respective opening/valve.

If two or more (preferably all) of the inflatable elements of the apparatus are joined together to form a single inflatable chamber, then the single inflatable chamber may be configured to have air continuously pumped through it when the apparatus is in use. To achieve this, the inflatable elements which form the single inflatable chamber may have one or more secondary openings to allow air to exit the single inflatable chamber. This configuration would allow the inflatable elements to continue to stay inflated even with small failures/punctures, and would also allow air to be released from the inflatable elements during compression thereof, thereby reducing the risk of failure/puncture during compression. This configuration would be particularly useful if an inflatable floor is one of the inflatable elements, since it would allow to allow users to bounce on the floor without undue risk of failure/puncture. This configuration would also be useful for a large-scale version of the apparatus, e.g. having a height or width dimension of more than 2 meters. The apparatus may include a pump configured to continuously pump air through the single inflatable chamber whilst the apparatus is in use.

The apparatus may include a plurality of balls. The balls may be hollow, and may be hollow plastic. The balls may have a variety of colours.

The invention also includes any combination of the aspects and preferred features described except where such a combination is clearly impermissible or expressly avoided.

BRIEF DESCRIPTION OF THE DRAWINGS

Examples of these proposals are discussed below, with reference to the accompanying drawings in which:

FIG. 1(*b*) shows the first ball pit apparatus 100 when suction ceases to be provided to the ball chamber of the first ball pit apparatus 100.

FIG. 3(*b*) shows an example method for constructing an inflatable support 330 having the structure shown in shown in FIG. 3(*a*), albeit with a different number of tube support elements 372.

DETAILED DESCRIPTION

Figure 1A:
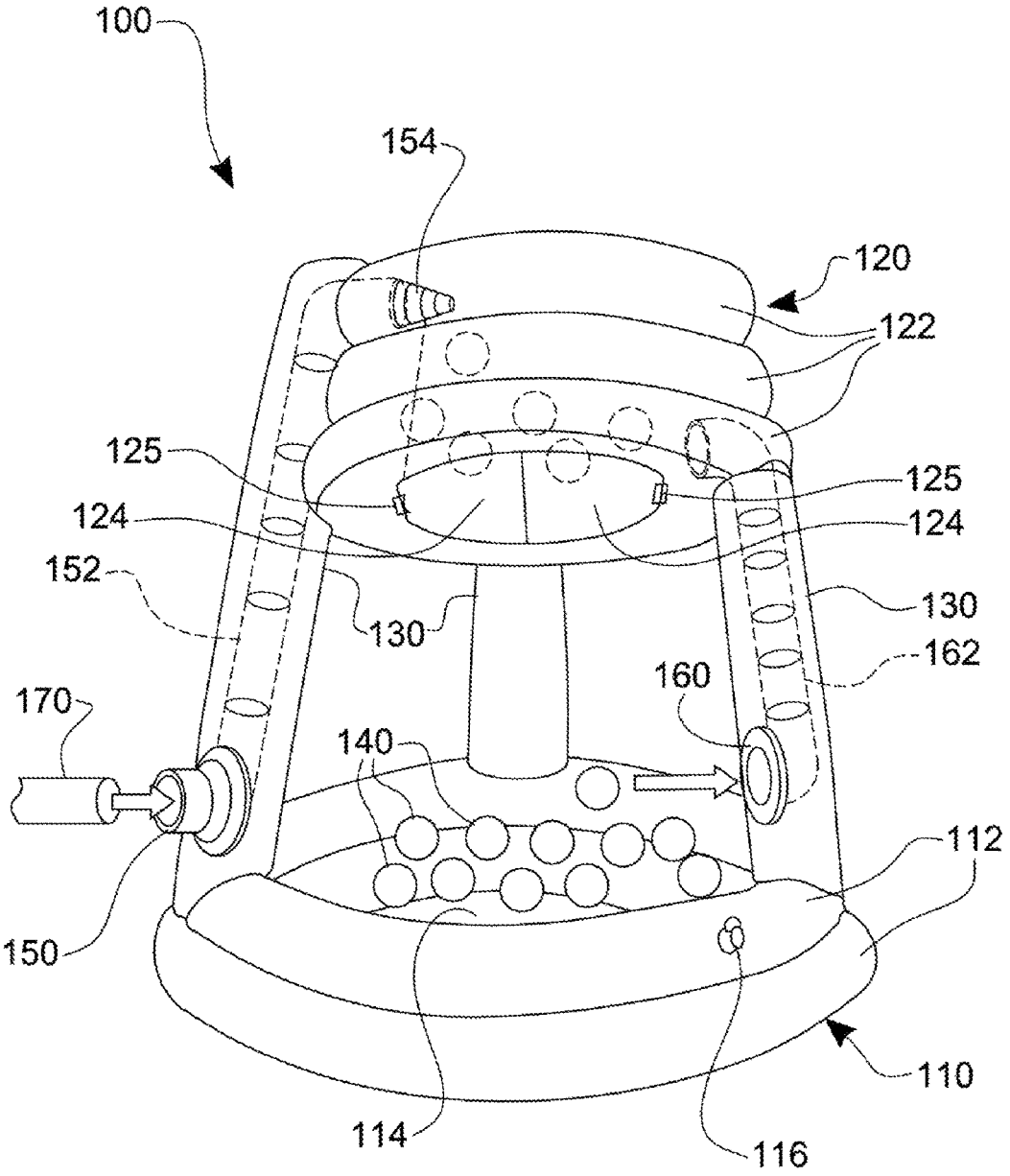
FIG. 1(*a*) shows a first ball pit apparatus 100 when suction is provided to a ball chamber of the first ball pit apparatus 100.
Figure 1B:
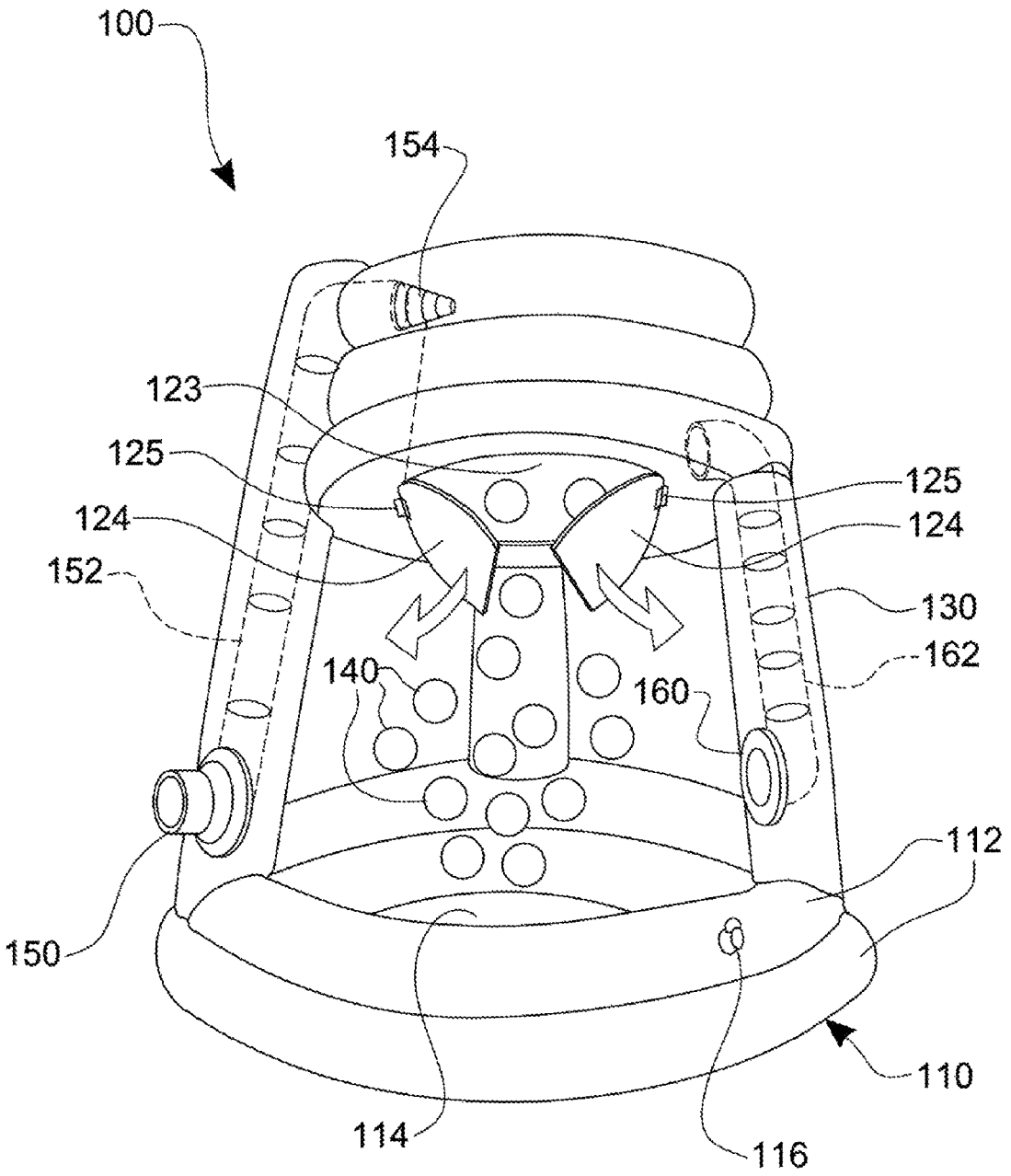

A first ball pit apparatus 100 shown in FIGS. 1(*a*) and 1(*b*) has a base portion 110, a roof portion 120 and three inflatable supports 130.

The base portion 110 is configured to provide a ball pit for holding a plurality of balls 140. In this example, the base portion 110 includes a circular inflatable side wall 112 formed of two stacked rings. The inflatable side wall 112 is configured to, when inflated, extend around a periphery of the base portion 110. FIGS. 1(*a*) and 1(*b*) show the inflatable side wall 112 in an inflated condition. The base portion 110 may also include a floor 114, which is preferably non-inflatable.

The roof portion 120 is configured to provide a ball chamber for holding a plurality of balls above the base portion 110. In this example, the roof portion 120 includes a circular inflatable side wall 122 formed of three stacked rings. The inflatable side wall 122 is configured to, when inflated, extend around a periphery of the roof portion 120. FIGS. 1(*a*) and 1(*b*) show the inflatable side wall 122 in an inflated condition.

The roof portion 120 also includes an opening 123 configured to face the base portion 110 when the inflatable supports 130 are inflated, and blocking elements provided in the form of two rigid trap doors 124. Each trap door 124 is attached to the roof portion 120 at the periphery of the opening 123 via a respective hinge 125. The trap doors 124 are configured to be held in a closed position to block the opening 123 when suction is provided to the ball chamber, as shown in FIG. 1(*a*), and to fall open under the action of gravity to hang in an open position so as to unblock the opening, and therefore allow balls in the ball chamber to fall into the ball pit, when suction ceases to be provided to the ball chamber, as shown in FIG. 1(*b*).

The three inflatable supports 130 are configured to, when inflated, hold the roof portion 120 above the base portion 110. For avoidance of any doubt, FIGS. 1(*a*) and 1(*b*) show the inflatable supports 130 in an inflated condition.

The first ball pit apparatus 100 includes a suction inlet 150 that is in fluid communication with the ball chamber so that, when suction is provided at the suction inlet 150, suction is also provided to the ball chamber.

In this example, the suction inlet 150 is located on an inflatable support 130, in a location nearer to the base portion 110 than the roof portion 120, and on a side of the inflatable support 130 that faces away from the ball pit.

Fluid communication between the suction inlet 150 and the ball chamber is provided by a suction tube 152, wherein at least a portion of the suction tube 152 is enclosed within and extends along at least a portion of the inflatable support 130 on which the suction inlet 150 is located. The suction tube includes an end which is distal to the suction inlet 150 and open to the ball chamber, wherein a rigid porous body in the form of a conical cage 154 is configured to prevent the distal end of the suction tube 152 from becoming blocked by any balls in the ball chamber when suction is being provided to the ball chamber.

The suction tube 152 should be configured to stay open under suction when the inflatable support 130 is inflated. This may be achieved as described below in connection with FIGS. 3(*a*) and 3(*b*).

The first ball pit apparatus 100 also includes a ball inlet 160 configured to be in fluid communication with the ball chamber so that, when suction is provided to the ball chamber, a ball 140 received at the ball inlet 160 is drawn into the ball chamber.

In this example, the ball inlet 160 is located on an inflatable support 130, in a location nearer to the base portion 110 than the roof portion 120, and on a side of the inflatable support 130 that faces towards the ball pit.

Fluid communication between the ball inlet 160 and the ball chamber is provided by a ball tube 162, wherein at least a portion of the ball tube 162 is enclosed within and extends along at least a portion of the same inflatable support 130. An end of the ball tube 162 distal to the ball inlet is open to the ball chamber.

The ball tube 162 should be configured to stay open under suction to allow balls to pass therethrough when the inflatable support 130 is inflated. This may be achieved as described below in connection with FIGS. 3(*a*) and 3(*b*).

In use, the ball pit provided by the base portion 110 may be filled with balls 140, which may be e.g. hollow plastic balls, and a suction device connected to the suction inlet 150 so as to provide suction at the suction inlet, which in turn causes suction to be provided to the ball chamber via suction tube 152. After closing the trap doors 124 by hand, the trap doors 124 are held in a closed position to block the opening 123 by the suction provided to the ball chamber.

Although in this example the trap doors 124 are closed by hand, use of a stronger suction device or use of another closure mechanism may allow the trap doors 124 to be closed without manual assistance.

The suction device may be a vacuum cleaner having a nozzle 170, as shown in FIG. 1(*a*). The vacuum cleaner may be connected to the suction inlet 150 by inserting the nozzle 170 into the suction inlet 150.

As the suction device continues to operate, a user (e.g. a child) may manipulate balls 140 to be received at the ball inlet 160, where they are drawn into the ball chamber via the ball tube 162, as shown in FIG. 1(*a*).

At a predetermined time, a user (e.g. a supervising adult) causes suction to cease to be provided to the ball chamber (e.g. by turning off or disconnecting the suction device). At this point, with suction no longer being provided to the ball chamber, the trap doors 124 fall open under the action of gravity to hang in an open position so as not to block the opening 123, causing any balls held in the ball chamber to fall down into the ball pit.

The inflatable elements (in this example the inflatable side wall 112 of the base portion 110, the inflatable side wall 122 of the roof portion 120 and the inflatable supports 130) are joined together to form a single inflatable chamber. This allows all of the inflatable elements to all be inflated together, via a single valve 116 located on the base portion 110. Once inflated, the valve 116 can be plugged as shown in FIGS. 1(*a*) and 1(*b*) to retain the inflatable elements in an inflated condition.

In other examples (not shown), the valve 116 could be replaced by an opening configured to be connected to a pump that operates to continuously pump air through the single inflatable chamber when the ball pit apparatus is in use, whilst one or more secondary openings in the inflatable elements would allow air to exit the single inflatable chamber. This configuration would allow the inflatable elements to continue to stay inflated even with small failures/punctures, and the second opening(s) would also allow air to be released from the inflatable elements during compression thereof, thereby reducing the risk of failure/puncture during compression. This configuration may be appropriate, for example, should the floor 114 be replaced with an inflatable floor, e.g. to allow users to bounce on the floor without undue risk of failure/puncture. This configuration would also be useful for a large-scale version of the apparatus, e.g. having a height or width dimension of more than 2 meters.

Of course, it would be possible for each of the inflatable elements to have a respective inflatable chamber and a respective opening/valve.

The inflatable elements may be made of a flexible sheet material, preferably a flexible sheet material that can be heat or sonic welded and/or solvent glued/stitched to form an air tight seal. One such material is PVC, though others are known to those skilled in the art.

Figure 2:
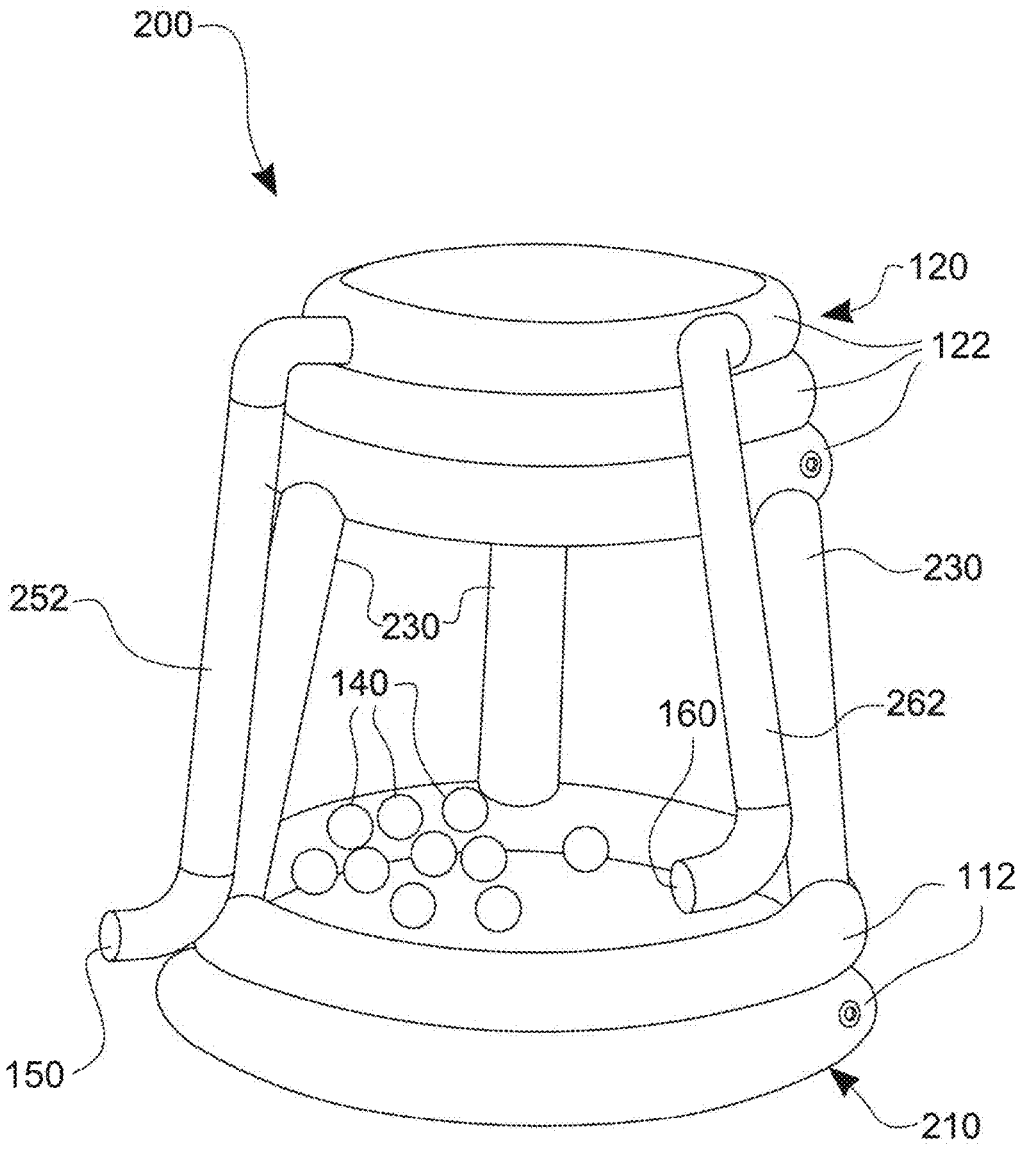
FIG. 2 shows a second ball pit apparatus 200.

The second ball pit apparatus 200 shown in FIG. 2 is similar to the first ball pit apparatus 100 shown in FIGS. 1(*a*) and 1(*b*). Alike elements have been given corresponding reference numerals and need not be described in further detail.

Unlike in the first ball pit apparatus 100 shown in FIG. 1, the second ball pit apparatus 200 shown in FIG. 2 is provided with a suction tube 252 which is external to the inflatable supports 230. The suction tube 252 extends towards the base portion 210 so as to allow for easy connection to an external suction device.

Also unlike in the first ball pit apparatus 100 shown in FIG. 1, the second ball pit apparatus 200 shown in FIG. 2 is provided with a ball tube 262 which is external to the inflatable supports 230. The external ball tube 262 extends towards the base portion 210 and is preferably flexible or at least includes a flexible portion to allow a user to manipulate its shape and maneuver it towards balls 140 in the ball pit.

Figure 3A:
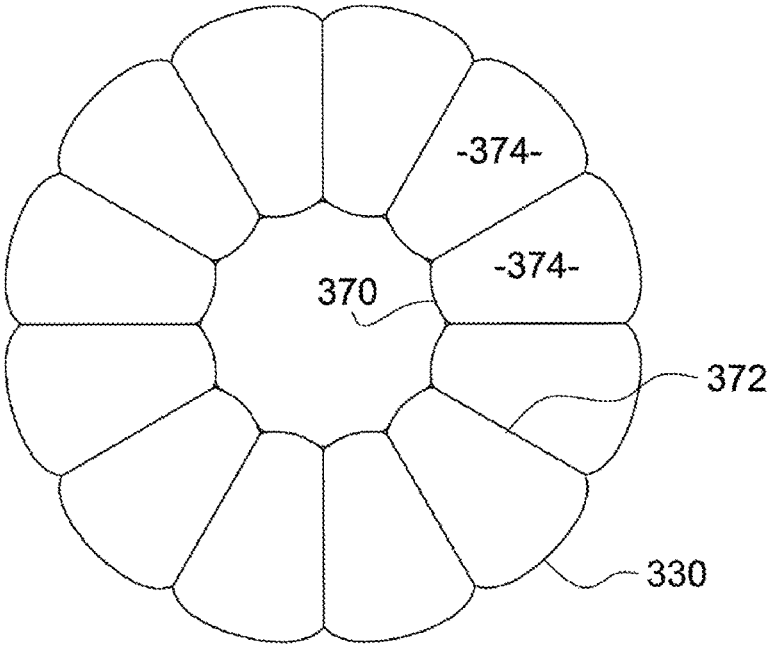
FIG. 3(*a*) shows an example of a tube 370 that is enclosed within and extends along at least a portion of an inflatable support 330, viewed in cross section through the inflatable support 330.
Figure 3B:
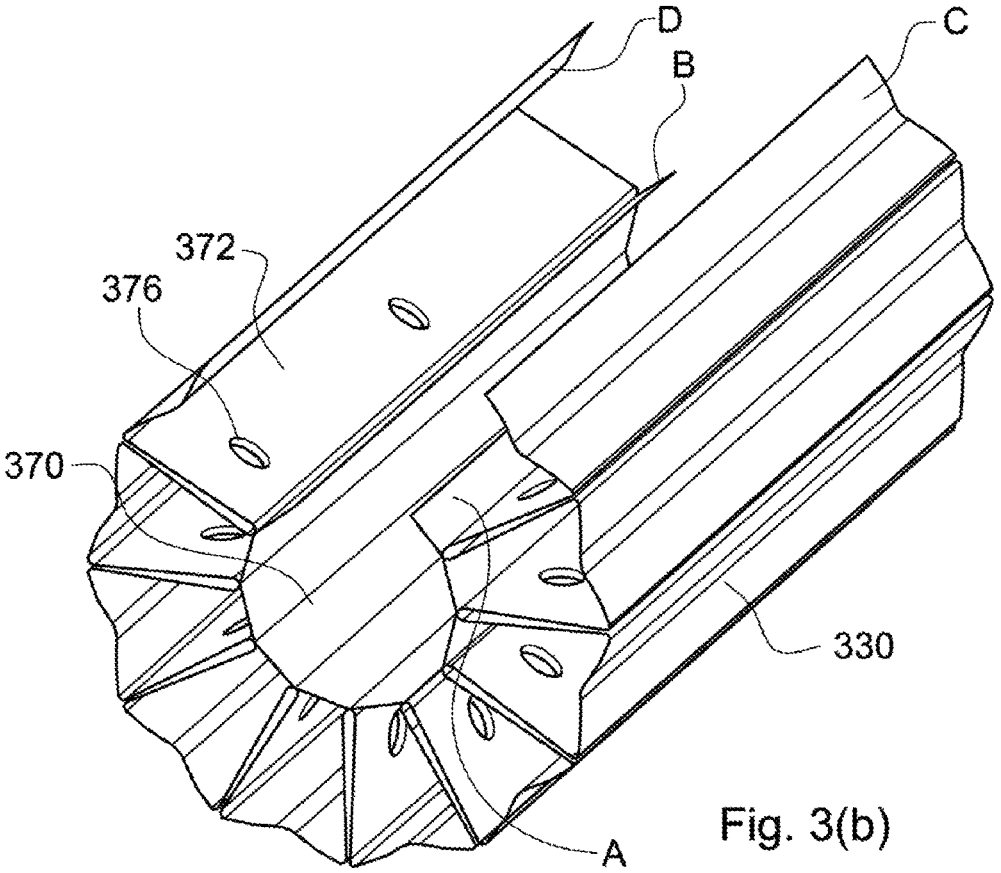

FIG. 3(*a*) shows an example of a tube 370 that is enclosed within and extends along at least a portion of an inflatable support 330, viewed in cross section through the inflatable support 330. A suction tube 152 and/or a ball tube 162 as described above, may take the form of the tube 370 shown in FIG. 3(*a*).

FIG. 3(*a*) shows the inflatable support 330 in an inflated condition. The tube 370 shown in FIG. 3(*a*) is configured to stay open when the inflatable support 330 is inflated, noting that pressure in the inflatable support 330, when inflated, would push inwards on the tube 370).

In this example, the tube 370 is configured to stay open when the inflatable support 330 is inflated by having a plurality of tube support elements 372 circumferentially distributed around the tube 370, each tube support element 372 being connected between the tube 370 and a wall of the inflatable support 330, wherein the plurality of tube support elements 372 are configured to act (through being under tension) to keep the tube 370 open when the inflatable support is inflated. In this particular example, there are twelve tube support elements 372, though other numbers are possible.

The tube support elements 372 define chambers 374. As shown in FIG. 3(*b*), the tube support elements 372 may incorporate openings 376 to allow air to pass between chambers 374 so that the chambers 374 can be inflated together.

The inflatable support 330, the tube 370 and the corresponding tube support elements 372 may be made of a flexible sheet material, in order to allow the inflatable support 330, tube 370 and corresponding tube support elements 372 to be stored flat when the inflatable support is deflated.

Consumers in 'deflation mood' can be impatient, and could seek to flatten the inflatable support 330 of FIG. 3(*a*) by aggressively standing on it, which could cause damage to the inflatable support 330, tube 370 and corresponding tube support elements 372. Instructions for the ball pit apparatus may be worded to deter users from such activity.

FIG. 3(*b*) shows an example method for constructing an inflatable support 330 having the structure shown in FIG. 3(*a*), albeit with a different number of tube support elements 372 (nine instead of twelve). In this example, the tube 370 is made of a first flexible sheet, and the inflatable support 330 and tube support elements 372 are made of a second (larger) flexible sheet. The second flexible sheet is folded to make both the tube support elements 372 and portions of the wall of the inflatable support 330. Therefore, in this example, each tube support element 372 is a length of folded over flexible sheet which is attached (e.g. by glue or welding) to the tube 370. The two layers forming each tube support element 372 are attached to each other (e.g. by glue or welding) at their radially outermost extent to provide a continuous outer wall for the support, as well as to stop air from leaking out of the inflatable support 330 (when inflated).

FIG. 3(*b*) shows the inflatable support 330 in a partially constructed form, with additional attachments being needed before the inflatable support 330 takes a fully constructed form, e.g. as shown in FIG. 3(*a*). In particular, to complete the construction of inflatable support 330 as shown in FIG. 3(*b*), it would be necessary to overlap and attach tab A to tab B to form the tube 370, and also to overlap and attach tab C to tab D to form the inflatable support 330. Such attachments may be achieved by a heat/sonic welding operation, for example.

Construction of an inflatable support 330 as shown in FIGS. 3(*a*) and 3(*b*) may require the development of a purpose built welding jig, where all elements of its construction are initially laid flat, with attachments then being made as shown in/described with reference to FIG. 3(*b*).

In some embodiments, an inflatable support 330 as shown in FIGS. 3(*a*) and 3(*b*) may be configured to be inflated separately from other elements of a ball pit apparatus. In this case, the base portion 110 and ball chamber 120 may incorporate a pliable plastic moulded location configured to allow the inflatable support 330 (when inflated) to be inserted into the location to provide a secure attachment. If the tube 370 is a suction tube, then the inflatable support 330 and tube 370 could be designed to make an efficient fluid communication to the vacuum system.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any references referred to above are hereby incorporated by reference. The following statements A1-A15 provide general expressions of the disclosure herein:

A1. A ball pit apparatus for use with a plurality of balls, the ball pit apparatus including: a base portion configured to provide a ball pit for holding a plurality of balls, wherein the base portion includes one or more inflatable side walls configured to, when inflated, extend around a periphery of the base portion; a roof portion configured to provide a ball chamber for holding a plurality of balls above the base portion; one or more inflatable supports configured to, when inflated, hold the roof portion above the base portion; a suction inlet configured to be in fluid communication with the ball chamber so that, when suction is provided at the suction inlet, suction is also provided to the ball chamber; a ball inlet configured to be in fluid communication with the ball chamber so that, when suction is provided to the ball chamber, a ball received at the ball inlet is drawn into the ball chamber; wherein the roof portion includes an opening configured to face the base portion when the one or more inflatable supports are inflated; wherein the roof portion includes at least one blocking element configured to block the opening so as to prevent balls from falling through the opening when suction is provided to the ball chamber and to not block the opening so as to allow balls to fall through the opening when suction is not provided to the ball chamber.

A2. A ball pit apparatus according to statement A1, wherein the apparatus includes a suction tube configured to provide the fluid communication between the suction inlet and the ball chamber.

A3. A ball pit apparatus according to statement A2, wherein at least a portion of the suction tube is enclosed within and extend along at least a portion of an inflatable support.

A4. A ball pit apparatus according to statement A3, wherein the inflatable support that encloses at least a portion of the suction tube has a plurality of suction tube support elements circumferentially distributed around the suction tube, each suction tube support element being connected between the suction tube and a wall of the inflatable support, wherein the plurality of suction tube support elements are configured to act to keep the suction tube open when the inflatable support is inflated.

A5. A ball pit apparatus according to statement A2, wherein the suction tube is external to the one or more inflatable supports.

A6. A ball pit apparatus according to any one of statements A2-A5, wherein the suction tube includes an end which is distal to the suction inlet and open to the ball chamber, wherein a rigid porous body is configured to prevent the distal end of the suction tube from becoming blocked by any balls in the ball chamber.

A7. A ball pit apparatus according to any previous statement A1-A6, wherein the apparatus includes a ball tube configured to provide fluid communication between the ball inlet and the ball chamber.

A8. A ball pit apparatus according to statement A7, wherein the ball tube is enclosed within and extend along at least a portion of an inflatable support.

A9. A ball pit apparatus according to statement A8, wherein the inflatable support that encloses at least a portion of the ball tube has a plurality of ball tube support elements circumferentially distributed around the ball tube, each ball tube support element being connected between the ball tube and a wall of the inflatable support, wherein the plurality of ball tube support elements are configured to act to keep the ball tube open when the inflatable support is inflated.

A10. A ball pit apparatus according to statement A7, wherein the ball tube is external to the one or more inflatable supports.

A11. A ball pit apparatus according to any previous statement A1-A10, wherein the roof portion includes one or more inflatable side walls configured to, when inflated, extend around a periphery of the roof portion.

A12. A ball pit apparatus according to any previous statement A1-A11, wherein the at least one blocking element includes at least one trap door, preferably two trap doors, the/each trap door being attached to the roof portion via a respective hinge.

A13. A ball pit apparatus according to any previous statement A1-A12, wherein two or more inflatable elements of the apparatus are joined together to form a single inflatable chamber.

A14. A ball pit apparatus according to statement A13, wherein the single inflatable chamber is configured to have air continuously pumped through it when the apparatus is in use, and the inflatable elements which form the single inflatable chamber have one or more secondary openings to allow air to exit the single inflatable chamber.

A15. A ball pit apparatus substantially as any one embodiment herein described with reference to and as shown in the accompanying drawings.

The invention claimed is:

1. A ball pit apparatus for use with a plurality of balls, the ball pit apparatus including:

a base portion configured to provide a ball pit for holding a plurality of balls, wherein the base portion includes one or more inflatable side walls configured to, when inflated, extend around a periphery of the base portion;

a roof portion configured to provide a ball chamber for holding a plurality of balls above the base portion;

one or more inflatable supports configured to, when inflated, hold the roof portion above the base portion;

a suction inlet configured to be in fluid communication with the ball chamber so that, when suction is provided at the suction inlet, suction is also provided to the ball chamber;

a ball inlet configured to be in fluid communication with the ball chamber so that, when suction is provided to the ball chamber, a ball received at the ball inlet is drawn into the ball chamber;

wherein the roof portion includes an opening configured to face the base portion when the one or more inflatable supports are inflated;

wherein the roof portion includes at least one blocking element configured to block the opening so as to prevent balls from falling through the opening when suction is provided to the ball chamber and to not block the opening so as to allow balls to fall through the opening when suction is not provided to the ball chamber;

wherein the apparatus includes a suction tube configured to provide the fluid communication between the suction inlet and the ball chamber;

wherein at least a portion of the suction tube is enclosed within and extends along at least a portion of a first inflatable support of the one or more inflatable supports; and wherein the first inflatable support that encloses at least a portion of the suction tube has a plurality of suction tube support elements circumferentially distributed around the suction tube, each suction tube support element being connected between the suction tube and a wall of the first inflatable support, wherein the plurality of suction tube support elements are configured to act to keep the suction tube open when the first inflatable support is inflated.

2. A ball pit apparatus according to claim 1, wherein the suction tube includes an end which is distal to the suction inlet and open to the ball chamber, wherein a rigid porous body is configured to prevent the distal end of the suction tube from becoming blocked by any balls in the ball chamber.

3. A ball pit apparatus according to claim 1, wherein the suction inlet may be configured to receive a nozzle of a vacuum cleaner.

4. A ball pit apparatus according to claim 1, wherein the apparatus includes a ball tube configured to provide fluid communication between the ball inlet and the ball chamber.

5. A ball pit apparatus according to claim 4, wherein the ball tube is enclosed within and extends along at least a portion of a second inflatable support of the one or more inflatable supports.

6. A ball pit apparatus according to claim 5, wherein the second inflatable support that encloses at least a portion of the ball tube has a plurality of ball tube support elements circumferentially distributed around the ball tube, each ball tube support element being connected between the ball tube and a wall of the second inflatable support, wherein the plurality of ball tube support elements are configured to act to keep the ball tube open when the second inflatable support is inflated.

7. A ball pit apparatus according to claim 4, wherein the ball tube is external to the one or more inflatable supports.

8. A ball pit apparatus according to claim 1, wherein the roof portion includes one or more inflatable side walls configured to, when inflated, extend around a periphery of the roof portion.

9. A ball pit apparatus according to claim 1, wherein the at least one blocking element includes at least one trap door attached to the roof portion via a hinge.

10. A ball pit apparatus according to claim 9, wherein the at least one trap door is configured to hang in an open position so as not to block the opening when suction is not provided to the ball chamber yet be held in a closed position to block the opening when suction is provided to the ball chamber such that, in use, the at least one trap door falls open under the action of gravity when suction ceases to be provided to the ball chamber.

11. A ball pit apparatus according to claim 1, wherein two or more of the one or more inflatable supports and one or more inflatable side walls are joined together to form a single inflatable chamber.

12. A ball pit apparatus according to claim 11, wherein the single inflatable chamber is configured to have air continuously pumped through it when the apparatus is in use, and the single inflatable chamber allows air to exit the single inflatable chamber.

13. A ball pit apparatus for use with a plurality of balls, the ball pit apparatus including:

a base portion configured to provide a ball pit for holding a plurality of balls, wherein the base portion includes one or more inflatable side walls configured to, when inflated, extend around a periphery of the base portion;

a roof portion configured to provide a ball chamber for holding a plurality of balls above the base portion;

one or more inflatable supports configured to, when inflated, hold the roof portion above the base portion;

a suction inlet configured to be in fluid communication with the ball chamber so that, when suction is provided at the suction inlet, suction is also provided to the ball chamber;

a ball inlet configured to be in fluid communication with the ball chamber so that, when suction is provided to the ball chamber, a ball received at the ball inlet is drawn into the ball chamber;

wherein the roof portion includes an opening configured to face the base portion when the one or more inflatable supports are inflated;

wherein the roof portion includes at least one blocking element configured to block the opening so as to prevent balls from falling through the opening when suction is provided to the ball chamber and to not block the opening so as to allow balls to fall through the opening when suction is not provided to the ball chamber;

wherein the apparatus includes a ball tube configured to provide fluid communication between the ball inlet and the ball chamber wherein the ball tube is enclosed within and extends along at least a portion of a first inflatable support of the one or more inflatable supports;

wherein the first inflatable support that encloses at least a portion of the ball tube has a plurality of ball tube support elements circumferentially distributed around the ball tube, each ball tube support element being connected between the ball tube and a wall of the first inflatable support, wherein the plurality of ball tube support elements are configured to act to keep the ball tube open when the first inflatable support is inflated.

14. A ball pit apparatus according to claim 13, wherein the apparatus includes a suction tube configured to provide the fluid communication between the suction inlet and the ball chamber.

15. A ball pit apparatus according to claim 14, wherein at least a portion of the suction tube is enclosed within and extends along at least a portion of a second inflatable support of the one or more inflatable supports.

16. A ball pit apparatus according to claim 14, wherein the suction tube is external to the one or more inflatable supports.

17. A ball pit apparatus according to claim 14, wherein the suction tube includes an end which is distal to the suction inlet and open to the ball chamber, wherein a rigid porous body is configured to prevent the distal end of the suction tube from becoming blocked by any balls in the ball chamber.

18. A ball pit apparatus according to claim 13, wherein the suction inlet is configured to receive a nozzle of a vacuum cleaner.

19. A ball pit apparatus according to claim 13, wherein the roof portion includes one or more inflatable side walls configured to, when inflated, extend around a periphery of the roof portion.

20. A ball pit apparatus according to claim 13, wherein the at least one blocking element includes at least one trap door attached to the roof portion via a hinge.

21. A ball pit apparatus according to claim 20, wherein the at least one trap door is configured to hang in an open position so as not to block the opening when suction is not provided to the ball chamber yet be held in a closed position to block the opening when suction is provided to the ball chamber such that, in use, the at least one trap door falls open under the action of gravity when suction ceases to be provided to the ball chamber.

22. A ball pit apparatus according to claim 13, wherein two or more of the one or more inflatable supports and one or more inflatable side walls are joined together to form a single inflatable chamber.

23. A ball pit apparatus according to claim 22, wherein the single inflatable chamber is configured to have air continuously pumped through it when the apparatus is in use, and the single inflatable chamber allows air to exit the single inflatable chamber.

* * * * *